US005734124A

United States Patent [19]

Bruenner et al.

[11] Patent Number: 5,734,124

[45] Date of Patent: Mar. 31, 1998

[54] LIQUID NITRATE OXIDIZER COMPOSITIONS

[75] Inventors: Rolf Sylvester Bruenner, Orangevale; Adolf Eduard Oberth, Fair Oaks; George Merrill Clark, Orangevale; Arthur Katzakian, Jr., Elk Grove, all of Calif.

[73] Assignee: Aerojet-General Corporation, Rancho Cordova, Calif.

[21] Appl. No.: 616,571

[22] Filed: Nov. 5, 1990

Related U.S. Application Data

[63] Continuation of Ser. No. 287,188, Dec. 20, 1988, abandoned.

[51] Int. Cl.[6] ..... C06B 31/00

[52] U.S. Cl. ..... 149/36; 149/45; 149/46; 149/61

[58] Field of Search ..... 149/36, 45, 46, 149/61, 19.1

[56] References Cited

U.S. PATENT DOCUMENTS

| | | | |
|---|---|---|---|
| 3,700,393 | 10/1972 | Mueller | 60/214 |
| 3,996,078 | 12/1976 | Klunsch et al. | 149/2 |
| 4,102,953 | 7/1978 | Johnson et al. | 149/19.8 |
| 4,128,443 | 12/1978 | Pawlak et al. | 149/71 |
| 4,401,490 | 8/1983 | Alexander et al. | 149/2 |
| 4,402,775 | 9/1983 | Wood | 149/46 |
| 4,461,214 | 7/1984 | Black | 102/440 |
| 4,527,389 | 7/1985 | Biddle et al. | 149/45 |
| 4,632,714 | 12/1986 | Abegg et al. | 149/2 |
| 4,710,248 | 12/1987 | Yates et al. | 149/46 |
| 4,722,757 | 2/1988 | Cooper et al. | 149/2 |
| 4,878,968 | 11/1989 | Willer et al. | 149/45 |

OTHER PUBLICATIONS

Block–Bolten et al., Proc. SPIE–Intl. Soc. Opt. Eng, vol. 872, publ. date–May 8, 1988—date the organization received mailing from publisher, per PTO Scientific Library inquiry.

Bondarevski:, *Chem. Abs.*, 81 (20), 130326u (1973).

Oxley et al., *Chem Abs.*, 109 (14), 116 84 gd (1988).

Block–Bolten et al., Chem Abs., 109 (10), 76237x (1988).

*Primary Examiner*—Edward A. Miller

*Attorney, Agent, or Firm*—Townsend and Townsend and Crew LLP

[57] ABSTRACT

Inorganic nitrate oxidizers are combined in novel eutectic compositions which place the oxidizers in liquid form at ambient temperatures. These liquid combinations are then used in the preparation of a wide variety of energetic formulations, notably solution and emulsion propellants.

18 Claims, No Drawings

LIQUID NITRATE OXIDIZER COMPOSITIONS

This is a Continuation of application Ser. No. 07/287,188, filed Dec. 20, 1988, now abandoned.

This invention relates to energetic formulations, and in particular to the oxidizers used in such formulations.

BACKGROUND OF THE INVENTION

Inorganic oxidizers find use in a variety of energetic formulations, including both propellants and explosives, where oxidizers are included as components separate from fuels. Such formulations include gun propellants, rocket propellants (liquid and solid), and cast explosives. Inorganic oxidizers, notably ammonium nitrate (AN) and ammonium perchlorate (AP), are common for this use. Other inorganic nitrate oxidizers used include hydrazinium nitrate (HN), hydroxylammonium nitrate (HAN), and lithium nitrate (LN). For composite and nitrocellulose-based propellants, the most commonly used inorganic oxidizer is ammonium perchlorate, whereas for those where a smokeless exhaust is required, the most common is ammonium nitrate.

Ammonium perchlorate, although a strong oxidizer, when combined with fuels has the disadvantage of producing upon decomposition large amounts of hydrogen chloride. Neither AN, HN, HAN nor LN, nor their mixtures, produce hydrogen chloride, and as a result, these oxidizers are preferred from environmental considerations. Also, all the commonly used oxidizer salts have melting points well above ambient temperatures. These high melting points pose processing difficulties and safety problems when one seeks to use these oxidizers in emulsion and solution-type composite propellants. To overcome some of these problems, various inventors have developed ways of placing these oxidizers in solution form, notably aqueous solutions, solutions with hydrazine and ammonia, and solid solutions. See, for example, U.S. Pat. Nos. 3,837,938, 2,704,706, 4,402,775, 3,523,047, 3,419,443, and 3,697,340.

SUMMARY OF THE INVENTION

It has now been discovered that certain combinations of ammonium nitrate, hydrazinium nitrate, hydroxylammonium nitrate and lithium nitrate form eutectics which render them liquid at temperatures in the range of ambient temperature. In particular, certain combinations and proportions of these nitrates are entirely liquid at temperatures of 30° C. or below. Preferred among these combinations are those which are entirely liquid at temperatures of 25° C. or below. Those which are entirely liquid at 20° C. or below are more preferred, and those which are entirely liquid at 10° C. or below are the most preferred.

These combinations are comprised of:

(a) one or both members of the group consisting of ammonium nitrate and hydrazinium nitrate, and (b) one member of the group consisting of hydroxylammonium nitrate and lithium nitrate, with the relative amounts of the components in each combination being within ranges which result in the combination being in a fully liquid state at the temperatures indicated above. The actual eutectics of some of these combinations are well below room temperature.

At certain proportions and temperatures, combinations of the above nitrates may form multiple phases in equilibrium. The terms "fully liquid" and "entirely liquid" are used herein to indicate those states where the combinations form single homogeneous liquid phases.

As liquids, these oxidizer combinations offer advantages to a wide variety of energetic formulations, in terms of the use of the formulations in some cases and the means by which they are prepared in others. These liquid oxidizer combinations are particularly useful in the preparation of solution and emulsion propellants. For formulations with a rubbery consistency, which are intended for use in large booster applications, these liquid oxidizers permit mixing, casting and curing of the formulation components at room temperature. Such propellants may be prepared, for example, by dissolving a monomer in the liquid oxidizers, adding various solid additives and a polymerization initiator, casting and curing, all at room temperature. In an alternative method, the liquid oxidizers are combined with solid additives and a polymer in powdered form, then the mixture is cast whereupon it will solidify into a propellant grain, again all at room temperature. Other formulations to which the liquid oxidizer combinations of this invention may be applied are liquid gun propellants, rocket propellants and cast explosives.

Further features and embodiments of the invention, as well as methods of preparation and use, will become apparent from the description which follows.

DETAILED DESCRIPTION OF THE INVENTION AND PREFERRED EMBODIMENTS

Combinations of inorganic nitrates within the scope of the present invention include:

ammonium nitrate, hydrazinium nitrate and hydroxylammonium nitrate;

ammonium nitrate and hydroxylammonium nitrate;

hydrazinium nitrate and hydroxylammonium nitrate; and ammonium nitrate, hydrazinium nitrate and lithium nitrate.

For the first of these combinations, preferred amounts of the components are about 3 to about 62 parts ammonium nitrate and hydrazinium nitrate combined, the remainder being hydroxylammonium nitrate. Most preferred are:

about 10 to about 30 parts ammonium nitrate, about 30 to about 50 parts hydrazinium nitrate, and about 30 to about 60 parts hydroxylammonium nitrate, all parts by weight, based on 100 parts total of the three components.

For the second, preferred amounts are about 3 to about 35 parts by weight ammonium nitrate, the remainder being hydroxylammonium nitrate. Most preferred amounts are about 25 to about 35 parts by weight ammonium nitrate.

For the third, preferred amounts are about 3 to about 55 parts by weight hydrazinium nitrate, with about 25 to about 35 parts by weight preferred, the remainder being hydroxylammonium nitrate.

For the fourth, preferred amounts are:

about 31 to about 43 parts ammonium nitrate, about 37.5 to about 51.5 parts hydrazinium nitrate, and about 15.5 to about 21.5 parts lithium nitrate, all parts by weight, based on 100 parts total of the three components. The eutectic of this fourth combination is approximately 27° C., and accordingly, proportions of the components producing a fully liquid mixture at temperatures within the range of about 27° C. to about 30° C. are preferred.

Melting point and hazard properties of illustrative combinations within the scope of the present invention are listed in Table I below, where they are compared with corresponding data for the known eutectic between ammonium nitrate and hydrazinium nitrate.

Procedures for determining the hazard properties were as follows.

Impact tests were run on a Bureau of Mines apparatus, by placing a small quantity of the sample on an anvil, and dropping a 2-kg weight in the shape of an inverted cone onto the sample from successive heights. Twenty successive trials were performed at each height. The height in centimeters at the 50% fire point (i.e., the height from which detonation occurred in 50% of the trials) was recorded.

Differential scanning calorimetry (DSC) tests were conducted according to standard procedures which involved heating the sample and a reference at a constant rate and maintaining an isothermal connection between the two by heating one or the other to correct for any detected temperature differences. A curve representing the heat flow rate vs. temperature produced an exotherm peak, whose onset and peak temperatures were noted as indications of the thermal stability of the formulations.

Spark tests to determine electrostatic sensitivity were performed using a spark discharge of 1.0 joule. The ">1.0" entry in the table indicates that no initiation occurred during twenty trials at that level.

Rotary friction tests were conducted by placing a quantity of the sample under a known weight rotating at a fixed rate (quoted in the Table), and noting the occurrence or absence of an explosion. Again, twenty trials were performed for a given weight. The ">4000" entry in the table indicates that no explosion occurred in any of the trials using a weight of 4000 grams.

Detonability tests were performed using standard Naval Ordnance Laboratory procedure. This involved a sample size of 5.5 inches (14.0 cm) in length and 1 7/16 inches (3.65 cm) in diameter, a steel witness plate measuring six inches (15.2 cm) square and 0.375 inch (0.95 cm) in thickness, two 2-inch diameter pentolite pellets and a J-2 blasting cap. The number of standard-size cards inserted between the sample and the blasting cap is indicated in the Table. The presence or absence of detonation was recorded.

TABLE I

HAZARD PROPERTIES OF OXIDIZER COMBINATIONS

| | AN/HN* | AN/HAN | HN/HAN | AN/HN/HAN | AN/HN/LN |
|---|---|---|---|---|---|
| Mole ratio | 1:2 | 1:2 | 1:2 | 1:2:2 | 1:1.2:0.5 |
| Melting point (°C.) | ~45 | ~5 | ~5 | ~5 | ~28 |
| Bu. of Mines Impact (cm/2 kg) | 69 | >100 | >100 | >100 | >100 |
| DSC: | | | | | |
| Exotherm onset (°C.) | >200 | 158 | 171 | 165 | >200 |
| Peak (°C.) | >200 | 176 | 199 | 192 | >200 |
| Spark sensitivity (joules) | >1.0 | >1.0 | >1.0 | >1.0 | >1.0 |
| Friction sensitivity (g @ 2000 rpm) | >4000 | >4000 | >4000 | >4000 | >4000 |
| Detonability, NOL Sleeve | | | | | |
| 0 cards | Pos | Neg | Neg | Neg | Neg |
| 69 cards | Neg | Neg | Neg | Neg | Neg |

*This is a known eutectic, included for reference only.

The advantage of the combinations of the present invention when compared with the AN/HN combination is evident not only in the melting point, but also in the lowered sensitivity to impact and the lowered detonability.

Thermogravimetric analyses of the combinations within the scope of the invention are listed in Table II below.

TABLE II

THERMOGRAVIMETRIC DATA (Taken at 5° C./min Under $N_2$)

| Composition (molar ratios) | Temperature at Onset of Decomposition (°C.) | Temperature at 25% Weight Loss (°C.) |
|---|---|---|
| AN | 142 | 194 |
| HAN | 108 | 134 |
| HN | 142 | 182 |
| LN | >200 | >200 |
| HAN/AN (2:1) | 137 | 166 |
| HAN/HN (2:1) | 139 | 177 |
| HAN/HN/AN (2:2:1) | 131 | 170 |
| LN/HN/AN (0.5:1.2:1.0) | 181 | >200 |

Table II indicates that one advantage of the formulations of the invention is that they have a higher thermal stability than hydroxylammonium nitrate.

The energetic formulations to which the liquid oxidizer combinations of the present invention may be applied may contain any of a wide variety of other components and additives, depending on the nature of the composition, its final state (liquid, emulsion or solid), and its intended use. Two of the most prominent types of additional components are fuels and binders.

The fuel is preferably a metallic fuel, which term is intended to include both metals and metal hydrides. Examples are aluminum, aluminum hydride, beryllium, beryllium hydride and boron. Aluminum and boron are the most preferred. The fuel, and particularly aluminum, may assume any physical form providing sufficient surface area for burning, ranging from fine powder to slivers or staples.

Binders function as a fuel as well as provide structural characteristics desired for use in the energetic formulations. Preferred binders are polymeric materials, both natural and synthetic. These materials may be any of the polymeric materials known to be useful in formulating propellants. Examples of useful polymers are polyvinyl alcohols, polyacrylamides, polyammonium acrylates, polyimides, polyethers, hydroxyethyl celluloses and natural gums such as guar gum. As stated above, the composition may be formulated from a monomer, or from a prepolymer. Examples of monomers suitable for use are acrylamide, N-hydroxylacrylamide, N-methylacrylamide, N,N-dimethylacrylamide, methylene-bis-acrylamide, maleimide, N-hydroxymaleimide, and N-hydroxymethylmaleimide. Examples of suitable linear thermoplastic polymers are polyvinyl alcohol (PVA), polyacrylamide (PAA), polyethylene glycol (PEG), and polyammonium acrylate (PAmA). Preferred PVA polymers are those having weight average molecular weights greater than 200,000; preferred PAA polymers are those having weight average molecular weights greater than 6,000,000; and preferred PAmA polymers are those having weight average molecular weights greater than 4,000,000.

The amounts of metallic fuel and binder in the energetic formulation may vary. In most applications, best results will generally be achieved with the metallic fuel comprising about 5% to about 30% by weight of the composition, and with the oxidizer comprising from about to about 80%.

Further additives may be included in the formulations in accordance with known technology. Stabilizers for example may be included to enhance thermal stability, and sequestering agents may be included to remove metals such as iron, copper and nickel. Buffers and heavy metal sequestering or complexing agents may be used in combination to achieve the highest degree of thermal stability in a propellant formulation containing HAN-based oxidizers. Proper selection of these additives will increase the exothermic peak temperature by 100 degrees F. (56° C.) or more. Preferred buffers are ammonium or organic amine dihydrogen phosphates such as $NH_4H_2PO_4$, or diammonium or di-organic amine monohydrogen phosphates such as $(NH_4)_2HPO_4$. Preferred sequestering agents are phenanthroline or dipyridyl and their ring-substituted derivatives. Preferred amounts of both buffers and sequestering agents are from 0.1% to 3.0% each, based on the HAN content for oxidizer compositions where HAN is the second component. Other additives may include catalysts, extenders and plasticizers, depending on the final form or use of the composition and its application.

The performance properties of propellant compositions within the invention are given as predictions for certain formulations in Table III below, and are compared against a prior art composition using ammonium perchlorate in Table IV which follows. Table V lists the hazard properties of one of the oxidizer compositions of the invention, and shows the effect of the inclusion of ammonium dihydrogen phosphate and dipyridyl, as well as the hazard properties of a propellant formulation containing this combination. The densities in Table III are calculated from known individual solid densities. The data in Tables IV and V are the result of actual measurements.

In these tables, the following abbreviations are used in addition to those indicated above for Table I:

| | |
|---|---|
| $I_{sps}$ | specific impulse under standard conditions |
| $I_{s\ vac}$ | specific impulse against vacuum |
| OFR | oxygen/fuel ratio |
| $T_{CH}$ | combustion temperature in rocket motor chamber |
| $\sigma_m$ | maximum tensile strength |
| $\epsilon_m$ | elongation at maximum stress |
| $E_o$ | initial tangent modulus (stress/strain) |
| DTA | differential thermal analysis |

TABLE III

PERFORMANCE PREDICTIONS USING FORMULATIONS 65% OXIDIZER, 20% ALUMINUM AND 15% BINDER* (WEIGHT BASIS)

| Oxidizer Blend (mole ratio) | $I_{sps}$ (sec) | $I_{s\ vac}$ (sec) | OFR | Density (g/cc) | $T_{CH}$ (°K.) |
|---|---|---|---|---|---|
| HAN/HN/AN (2:2:1) | 262.1 | 285.6 | 1.509 | 1.782 | 3246 |
| HAN/HN (2:1) | 263.0 | 286.4 | 1.567 | 1.796 | 3351 |
| HAN/AN (2:1) | 259.4 | 282.5 | 1.646 | 1.806 | 3347 |
| HAN/HN (1:0.063) | 260.7 | 283.9 | 1.685 | 1.817 | 3453 |

*The binder was a crosslinked polyacrylamide formed from acrylamide and methylene-bis-acrylamide in a 9:1 weight ratio.

TABLE IV

PERFORMANCE COMPARISONS

| | Propellant A | Propellant B | Shuttle Booster |
|---|---|---|---|
| Oxidizer (mole ratio) | HAN/HN (2:1) | HAN/AN (1:0.063) | AP |
| $I_{sps}$ (theoretical) (sec) | 263 | 263 | 262 |
| Density (g/cc) | 1.757 | 1.714 | 1.773 |
| Ballistic loading (%) | 85 | 80 | 86 |
| $\sigma_m$ (psi) | 51 | 253 | 113 |
| $\epsilon_m$ (%) | 25.9 | 269 | 37 |
| $E_o$ (psi) | 199 | 229 | 520 |
| HCl in exhaust | none | none | 21.7 wt % of propellant |
| Processibility | excellent | excellent | good |

Propellant A: 65% oxidizer, 20% aluminum, 15% crosslinked polyacrylamide
Propellant B: 60% oxidizer, 20% aluminum, 20% polyvinyl alcohol

TABLE V

HAZARD PROPERTIES

| Test | HAN/AN (95/5) | Stabilized[1] HAN/AN (95/5) | Propellant Formulation[2] |
|---|---|---|---|
| Impact (cm) | >100 | 77 | 88 |
| Rotary Friction (g @ 2500 rpm) | >4000 | >4000 | >4000 |
| Spark (joules) | >1.0 | >1.0 | >1.0 |
| DTA[3] (°C.) | | | |
| Onset | 122 | 163 | 174 |
| Peak | 132 | 194 | 184 |
| Detonability, NOL (0 cards) | Neg | Neg | Pos |

TABLE V-continued

| HAZARD PROPERTIES | | | |
|---|---|---|---|
| Test | HAN/AN (95/5) | Stabilized[1] HAN/AN (95/5) | Propellant Formulation[2] |

[1]Stabilizers: ammonium dihydrogen phosphate and dipyridyl, 1% each by weight based on HAN

[2]Formulation: stabilized HAN/AN (95/5), 60%; Al, 20%; polyvinyl alcohol binder, 20%

[3]Differential thermal analyses were performed by heating the sample at a preset standard rate and recording the temperatures at which an exotherm was first observed ("Onset") and at its peak ("Peak"). The measurements were made with a thermocouple in a glass sleeve.

The foregoing is offered primarily for purposes of illustration. It will be readily apparent to those skilled in the art that numerous variations, modifications, and alternatives in terms of both materials and procedures may be utilized over those described herein without departing from the spirit and scope of the invention.

What is claimed is:

1. An oxidizer composition consisting essentially of a liquid-phase mixture selected from the group consisting of (i) ammonium nitrate and hydroxylammonium nitrate;

(ii) hydrazinium nitrate and hydroxylammonium nitrate;

(iii) ammonium nitrate, hydrazinium nitrate and hydroxylammonium nitrate; and (iv) ammonium nitrate, hydrazinium nitrate and lithium nitrate;

the components of each said mixture being in relative amounts such that the lowest temperature at which each said mixture is entirely liquid is within the range of about 30° C. or below.

2. An oxidizer composition in accordance with claim 1 in which said liquid-phase mixture is a member selected from the group consisting of (i) ammonium nitrate and hydroxylammonium nitrate;

(ii) hydrazinium nitrate and hydroxylammonium nitrate; and (iii) ammonium nitrate, hydrazinium nitrate and hydroxylammonium nitrate.

3. An oxidizer composition in accordance with claim 2 in which the lowest temperature at which each said mixture is entirely liquid is within the range of about 25° C. or below.

4. An oxidizer composition in accordance with claim 2 in which the lowest temperature at which each said mixture is entirely liquid is within the range of about 20° C. or below.

5. An oxidizer composition in accordance with claim 2 in which the lowest temperature at which each said mixture is entirely liquid is within the range of about 10° C. or below.

6. An oxidizer composition in accordance with claim 1 further comprising a buffer and a sequestering agent in amounts sufficient to increase the exotherm peak temperature by at least about 100° F.

7. An oxidizer composition in accordance with claim 1 in which said liquid-phase mixture is ammonium nitrate, hydrazinium nitrate and hydroxylammonium nitrate.

8. An oxidizer composition in accordance with claim 7 in which the composition of said liquid-phase mixture, in parts by weight based on 100 parts total, is:

about 3 to about 62 parts ammonium nitrate and hydrazinium nitrate combined, and about 35 to about 97 parts hydroxylammonium nitrate.

9. An oxidizer composition in accordance with claim 7 in which the composition of said liquid-phase mixture, in parts by weight based on 100 parts total, is:

about 10 to about 30 parts ammonium nitrate, about 30 to about 50 parts hydrazinium nitrate, and about 30 to about 60 parts hydroxylammonium nitrate.

10. An oxidizer composition in accordance with claim 1 in which said liquid-phase mixture is ammonium nitrate and hydroxylammonium nitrate.

11. An oxidizer composition in accordance with claim 10 in which the composition of said liquid-phase mixture, in parts by weight based on 100 parts total, is:

about 3 to about 35 parts ammonium nitrate, and about 65 to about 97 parts hydroxylammonium nitrate.

12. An oxidizer composition in accordance with claim 10 in which the composition of said liquid-phase mixture, in parts by weight based on 100 parts total, is:

about 25 to about 35 parts ammonium nitrate, and about 65 to about 75 parts hydroxylammonium nitrate.

13. An oxidizer composition in accordance with claim 1 in which said liquid-phase mixture is hydrazinium nitrate and hydroxylammonium nitrate.

14. An oxidizer composition in accordance with claim 13 in which the composition of said liquid-phase mixture, in parts by weight based on 100 parts total, is:

about 3 to about 55 parts hydrazinium nitrate, and about 55 to about 97 parts hydroxylammonium nitrate.

15. An oxidizer composition in accordance with claim 13 in which the composition of said liquid-phase mixture, in parts by weight based on 100 parts total, is:

about 25 to about 35 parts hydrazinium nitrate, and about 65 to about 75 parts hydroxylammonium nitrate.

16. An oxidizer composition in accordance with claim 1 in which said liquid-phase mixture is ammonium nitrate, hydrazinium nitrate and lithium nitrate.

17. An oxidizer composition in accordance with claim 16 in which the lowest temperature at which each said mixture is entirely liquid is within the range of about 27° C. to about 30° C.

18. An oxidizer composition in accordance with claim 16 in which the composition of said liquid-phase mixture, in parts by weight based on 100 parts total, is:

about 31 to about 43 parts ammonium nitrate, about 37.5 to about 51.5 parts hydrazinium nitrate, and about 15.5 to about 21.5 parts lithium nitrate.

* * * * *